US009946198B2

(12) United States Patent
Itabashi

(10) Patent No.: US 9,946,198 B2
(45) Date of Patent: Apr. 17, 2018

(54) DEVELOPING CARTRIDGE CAPABLE OF STOPPING MOVEMENT OF PROTRUSION OF GEAR

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/463,521

(22) Filed: Mar. 20, 2017

(65) Prior Publication Data

US 2018/0011423 A1 Jan. 11, 2018

(30) Foreign Application Priority Data

Jul. 8, 2016 (JP) ..... 2016-136003

(51) Int. Cl.
*G03G 15/08* (2006.01)
*G03G 21/16* (2006.01)

(52) U.S. Cl.
CPC ..... *G03G 15/0889* (2013.01); *G03G 15/0865* (2013.01); *G03G 21/1647* (2013.01)

(58) Field of Classification Search
CPC ..... G03G 15/0889
See application file for complete search history.

(56) References Cited

U.S. PATENT DOCUMENTS

2013/0051833 A1 2/2013 Itabashi et al.
2015/0002914 A1* 1/2015 Takahashi ..... F16H 25/12 358/484
2017/0023874 A1* 1/2017 Hanano ..... G03G 15/0225

FOREIGN PATENT DOCUMENTS

JP 2013-054056 A 3/2013

* cited by examiner

*Primary Examiner* — Victor Verbitsky
(74) *Attorney, Agent, or Firm* — Merchant & Gould P.C.

(57) ABSTRACT

A developing cartridge includes a casing to accommodate toner; an agitator to agitate the toner and rotatable about a first axis extending in a predetermined direction, the agitator including one end portion and another end portion in the predetermined direction, the agitator being movable in the predetermined direction between a first position and a second position; a first gear mounted to the one end portion and rotatable along with the agitator; an input gear engaging with the first gear; a second gear mounted to the another end portion and rotatable along with the agitator; a third gear; and a protrusion. The second gear is mounted to the another end portion while the first gear engages with the input gear in the first position. And the second gear is separated from the another end portion while the first gear engages with the input gear in the second position.

9 Claims, 11 Drawing Sheets

DEVELOPING CARTRIDGE CAPABLE OF STOPPING MOVEMENT OF PROTRUSION OF GEAR

CROSS REFERENCE TO RELATED APPLICATION

This application claims priority from Japanese Patent Application No. 2016-136003 filed Jul. 8, 2016. The entire content of the priority application is incorporated herein by reference.

TECHNICAL FIELD

The present disclosure relates to a developing cartridge.

BACKGROUND

A developing cartridge including a developing roller is known in the art. Such developing cartridge is mountable to an image forming apparatus.

Prior art discloses a developing cartridge provided with a gear rotatable from a first position to a second position. The gear includes a protrusion movable in accordance with the rotation of the gear to bring into contact with a lever of the image forming apparatus. The lever is moved by the contact with the protrusion. The image forming apparatus detects movement of the lever to determine a specification of the developing cartridge. The gear includes a gear teeth portion and toothless portion. The gear is rotated by a predetermined angle by the meshing engagement between the gear teeth portion and a drive gear for transmitting driving force to the gear. Upon rotation of the gear by the predetermined angle, the gear teeth portion is disengaged from the drive gear, so that the toothless portion faces the drive gear. Thus, driving force from the drive gear is not transmitted to the gear, stopping the rotation of the gear, thereby stopping movement of the protrusion.

SUMMARY

In the developing cartridge, a structure other than the employment of the conventional toothless portion is required for stopping movement of the protrusion.

It is therefore an object of the disclosure to provide a developing cartridge capable of stopping movement of the protrusion.

According to one aspect, there is provided a developing cartridge including: a casing configured to accommodate therein toner; an agitator configured to agitate the toner in the casing, the agitator being rotatable about a first axis extending in a predetermined direction, the agitator including one end portion and another end portion in the predetermined direction, the agitator being movable in the predetermined direction between a first position and a second position; a first gear mounted to the one end portion, the first gear being rotatable along with the agitator; an input gear engaging with the first gear; a second gear mounted to the another end portion, the second gear being rotatable along with the agitator; a third gear engaging with the second gear, the third gear being rotatable about a second axis extending in the predetermined direction; and a protrusion movable in accordance with a rotation of the third gear, the protrusion being rotatable along with the third gear. The second gear is mounted to the another end portion while the first gear and the input gear engage with each other in the first position. The second gear is separated from the another end portion while the first gear and the input gear engage with each other in the second position.

BRIEF DESCRIPTION OF THE DRAWINGS

The particular features and advantages of the disclosure will become apparent from the following description taken in connection with the accompanying drawings, in which.

DETAILED DESCRIPTION

A developing cartridge 1 according to a first embodiment will be described with reference to FIGS. 1 through 6.

First Embodiment

1. Outline of Developing Cartridge 1

Figure 2:
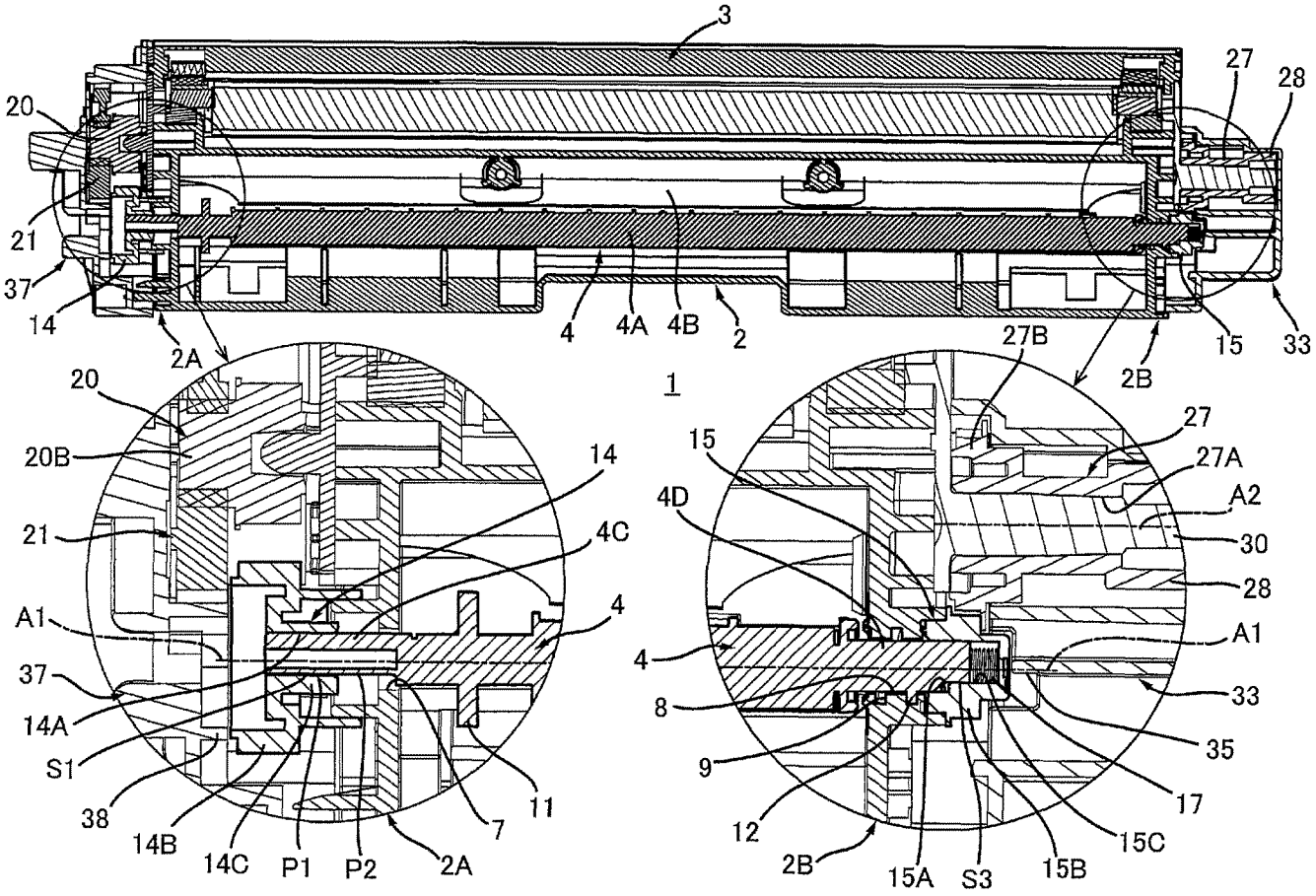
FIG. 2 is a cross-sectional view of the developing cartridge according to the first embodiment and illustrating a state where an agitator is at a first position.

The developing cartridge 1 is mountable to an image forming apparatus, and includes a casing 2, a developing roller 3, and an agitator 4 (FIG. 2). The developing roller 3 is rotatable about a rotation axis extending in a predetermined direction.

1.1 Casing 2

The casing 2 extends in the predetermined direction, and accommodates therein toner. In the following description, a toner accommodation side and a side opposite thereto of the casing 2 are an inside and an outside of the casing 2, respectively.

As illustrated in FIG. 2, the casing 2 includes one side wall 2A and another side wall 2B separated from the one side wall 2A in the predetermined direction. The other side wall 2B has a first through-hole 8 penetrating a thickness of the other side wall 2B, and the side wall 2A has a second through-hole 7 penetrating a thickness of the side wall 2A. The first through-hole 8 is formed with a groove 9. The groove 9 has a helical shape extending in the predetermined direction. The helical groove 9 is formed over an entire length of an inner peripheral surface of the first through-hole 8. Further, a shaft 30 extends outward in the predetermined direction from the outer surface of the other side wall 2B.

1.2 Developing Roller 3

The developing roller 3 extends in the predetermined direction. A portion of a peripheral surface of the developing roller 3 is exposed out of the casing 2 to an outside.

1.3 Agitator 4

As illustrated in FIG. 2, the agitator 4 is positioned inside the casing 2. The agitator 4 is configured to agitate toner in the casing 2, and to supply the toner to the developing roller 3. The agitator 4 is rotatable about a first axis A1 extending in the predetermined direction. The agitator 4 includes an agitator shaft 4A extending in the predetermined direction and a blade 4B extending in a direction crossing the predetermined direction. Toner in the casing 2 is subjected to agitation by the rotation of the blade 4B about the axis agitator shaft 4A.

2. Details of Agitator 4

Figure 3:
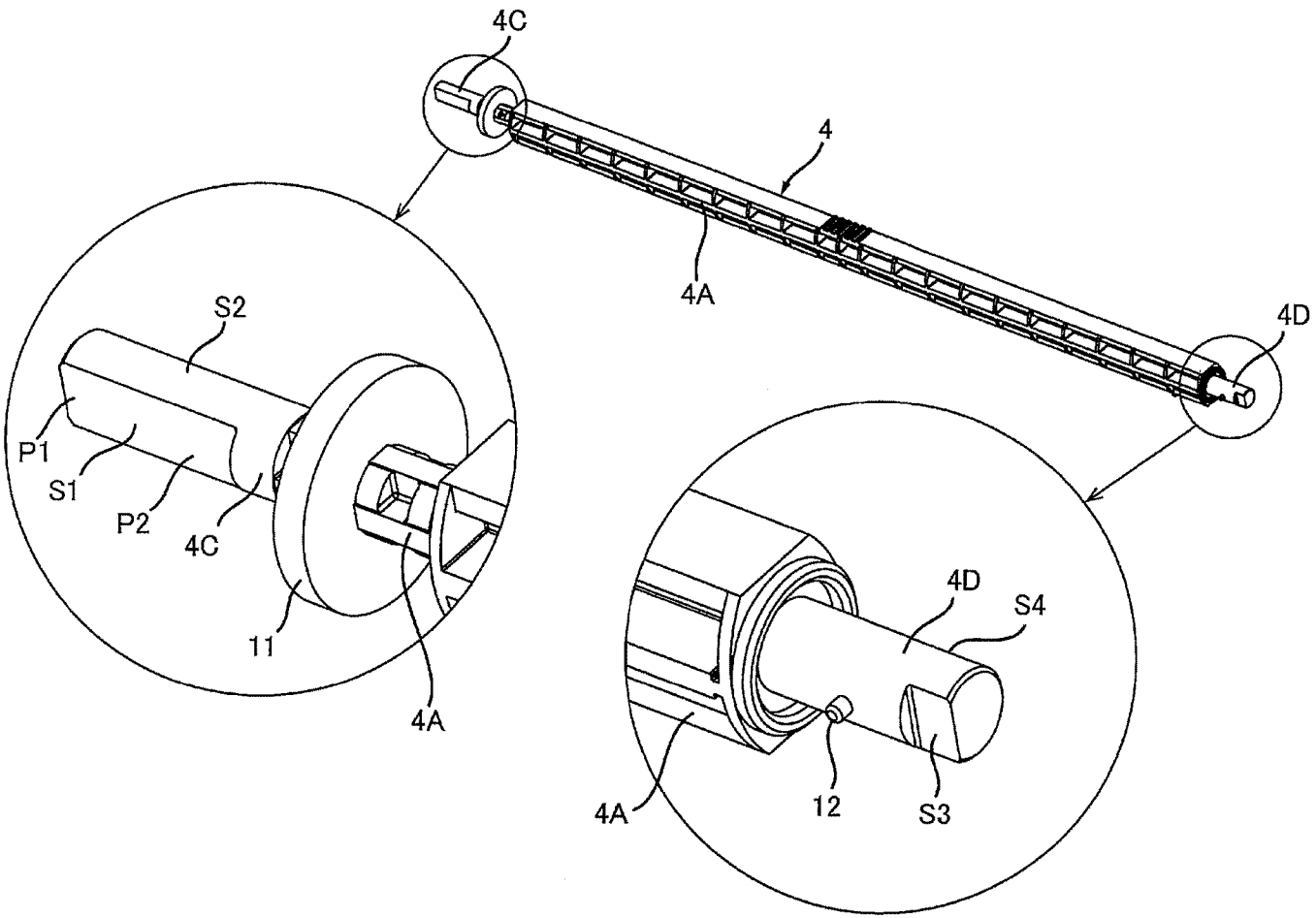
FIG. 3 is a perspective view of the agitator illustrated in FIG. 2 in the developing cartridge according to the first embodiment.

As illustrated in FIGS. 2 and 3, the agitator 4 includes one end portion 4C and another end portion 4D in the predetermined direction. Further, the agitator 4 includes a protrusion 11 and a boss 12.

Figure 4:
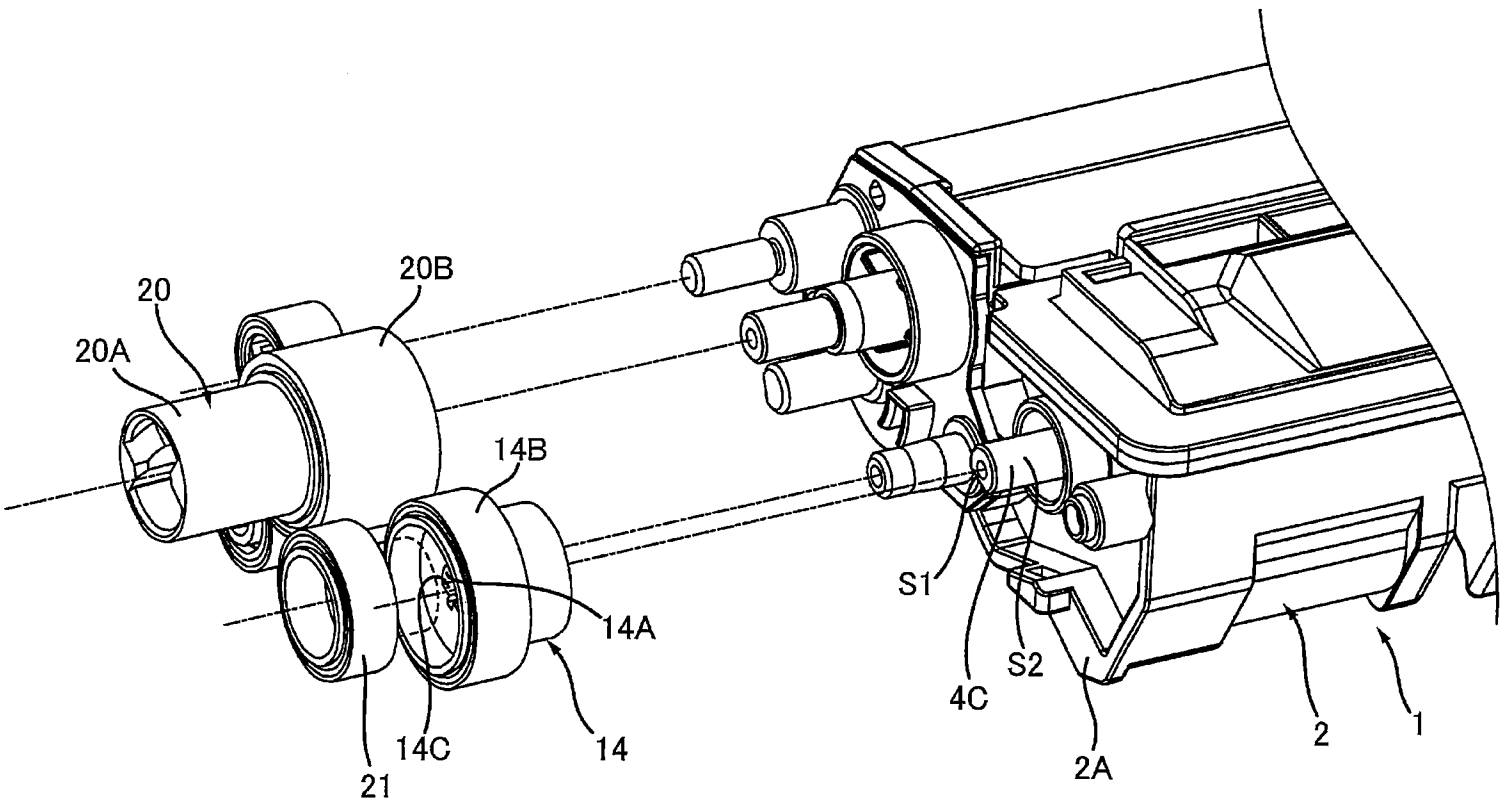
FIG. 4 is an exploded perspective view of components positioned at a first gear side in the developing cartridge according to the first embodiment.
Figure 5:
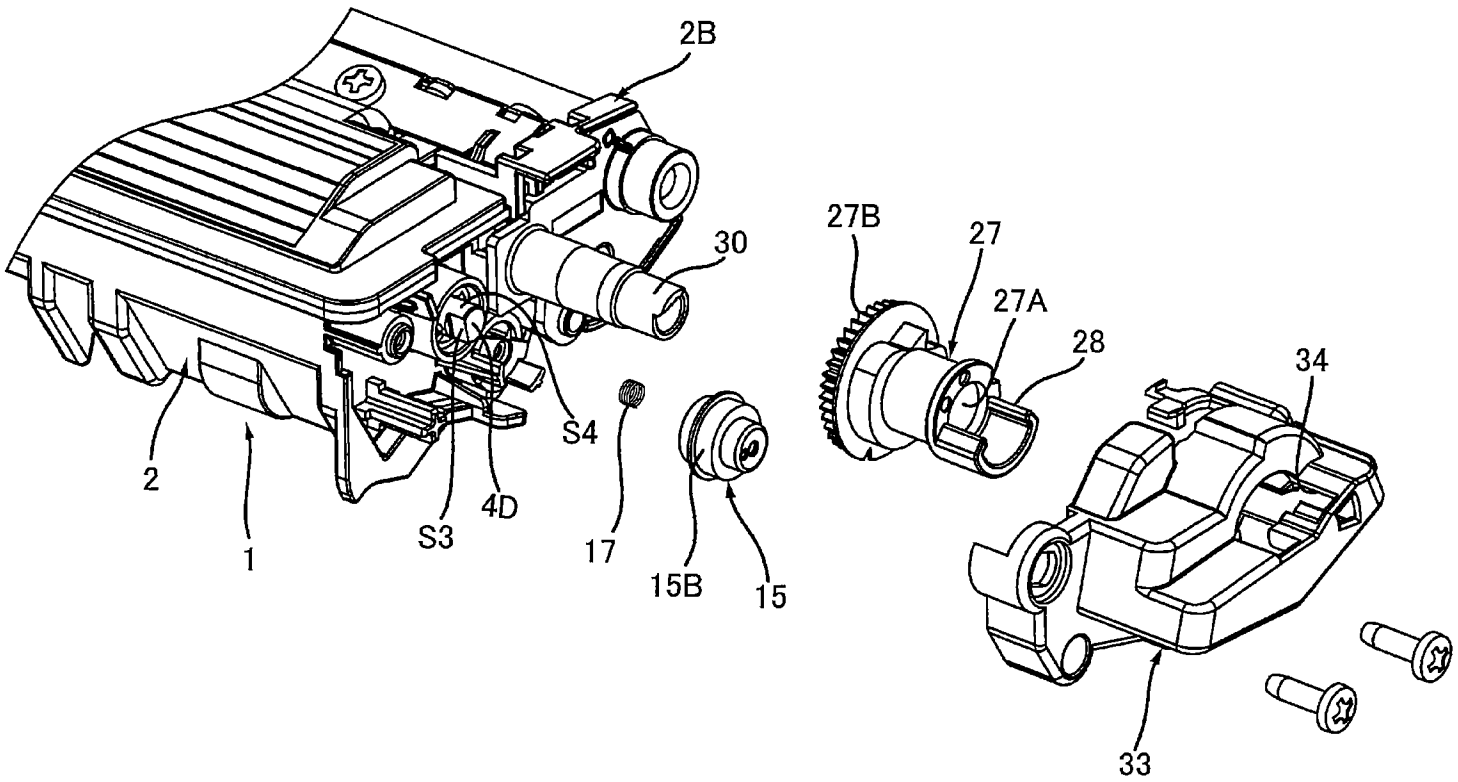
FIG. 5 is an exploded perspective view of components positioned at a second gear side in the developing cartridge according to the first embodiment.

As illustrated in FIGS. 3 and 4, the one end portion 4C has a D-shaped cross-section having a flat surface S1 and a remaining arcuate surface S2. The flat surface S1 extends in the predetermined direction. Further, as illustrated in FIGS. 3 and 5, the other end portion 4D has a D-shaped cross-section having a flat surface S3 and a remaining arcuate surface S4. The flat surface S3 extends in the predetermined direction and has a length greater than that of the S1 in the predetermined direction. The flat surface S3 is positioned opposite to the one end portion 4C with respect to the boss 12.

The one end portion 4C extends through the second through-hole 7 of the casing 2, and protrudes to the outside of the casing 2. The other end portion 4D extends through the first through-hole 8 of the casing 2, and protrudes to the outside of the casing 2.

The protrusion 11 is positioned between the one end portion 4C and the other end portion 4D in the predetermined direction as illustrated in FIGS. 2 and 3. Further, the protrusion 11 is positioned closer to the one end portion 4C than to the other end portion 4D in the predetermined direction. The protrusion 11 protrudes radially outwardly from a peripheral surface of the agitator shaft 4A. The protrusion 11 is positioned inside the casing 2 and faces an inner surface of the casing 2 in the predetermined direction in a state where the protrusion 11 is attached to the casing 2. The protrusion 11 faces an inner surface of the casing 2 in the predetermined direction in the state where the agitator 4 is attached to the casing 2. More specifically, the protrusion 11 faces an open end of the second through-hole 7 on the inner surface of the casing 2 in the state where the agitator 4 is attached to the casing 2.

The boss 12 is positioned at the other end portion 4D of the agitator 4, and protrudes radially outwardly from the peripheral surface of the other end portion 4D. The boss 12 is integral with the other end portion 4D of the agitator 4. As illustrated in FIG. 2, the boss 12 engages with the groove 9 of the casing 2.

Figure 6:
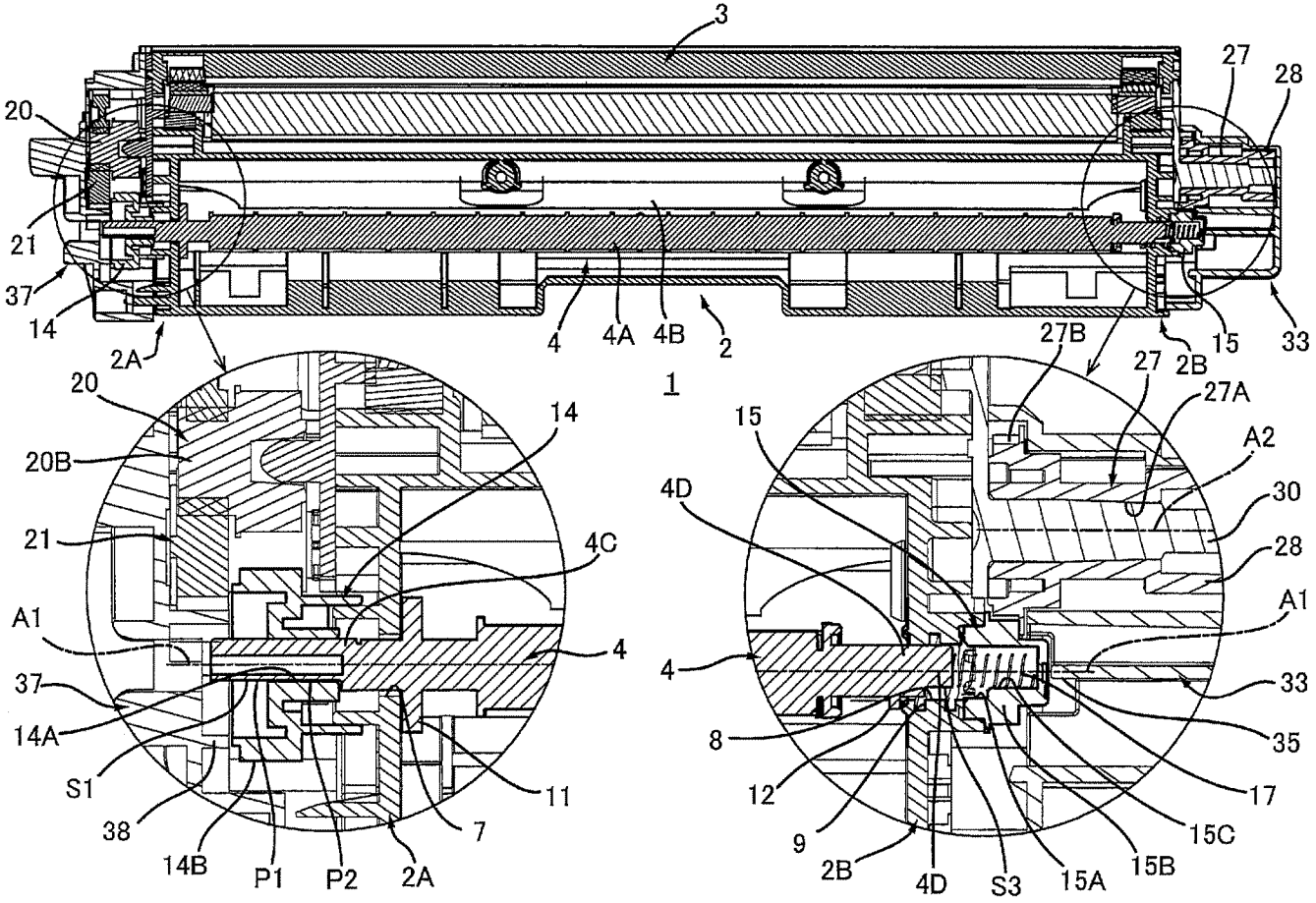
FIG. 6 is a cross-sectional view of the developing cartridge according to the first embodiment and illustrating a state where the agitator is at a second position.

The agitator 4 is movable from a first position illustrated in FIG. 2 to a second position illustrated in FIG. 6 in the predetermined direction.

More specifically, when the agitator 4 is positioned at the first position, the boss 12 engages with the groove 9 and the protrusion 11 is positioned away from the inner surface of the casing 2 in the predetermined direction, as illustrated in FIG. 2.

When the agitator 4 is positioned at the second position, the boss 12 disengages from the groove 9 to be positioned inside the casing 2, as illustrated in FIG. 6, and the protrusion 11 is in contact with the inner surface of the casing 2 in the predetermined direction, as illustrated in FIG. 6.

3. Coupling 20, Input Gear 21 and First Gear 14

As illustrated in FIGS. 2 and 4, the developing cartridge 1 further includes a coupling 20, an input gear 21, and a first gear 14.

3.1 Coupling 20

The coupling 20 is positioned at an outer surface of the side wall 2A in the predetermined direction. The coupling 20 is rotatable about a rotation axis extending in the predetermined direction. The coupling 20 includes a coupling piece 20A, and a coupling gear 20B.

The coupling piece 20A is configured to receive driving force from the image forming apparatus in a state where the developing cartridge 1 is attached to the image forming apparatus. The coupling piece 20A is one end portion of the coupling 20 in the predetermined direction, and is positioned opposite to the casing 2 with respect to the coupling gear 20B in the predetermined direction. The coupling piece 20A is engageable with a drive input portion of the image forming apparatus. With the engagement, the coupling 20 can receive driving force from the drive input portion of the image forming apparatus.

The coupling gear 20B is positioned between the coupling piece 20A and the casing 2 in the predetermined direction. The coupling gear 20B is rotatable together with the coupling piece 20A. The coupling gear 20B includes a plurality of gear teeth provided at a peripheral surface of the coupling gear 20B.

3.2 Input Gear 21

The input gear 21 is positioned at the outer surface of the side wall 2A of the casing 2 in the predetermined direction, and is meshingly engaged with the coupling gear 20B. The input gear 21 is rotated upon receipt of driving force from the coupling 20.

3.3 First Gear 14

The first gear 14 is positioned at the outer surface of the side wall 2A of the casing 2 in the predetermined direction, and is mounted to the one end portion 4C of the agitator 4 in the predetermined direction. The first gear 14 has a hole 14A as illustrated in FIGS. 2 and 4. The hole 14A extends through the first gear 14 in the predetermined direction. The one end portion 4C of the agitator 4 is inserted into the hole 14A. The hole 14A has a shape in conformance with the cross-sectional shape of the one end portion 4C. That is, an inner peripheral surface of the hole 14A has a flat surface 14C.

The flat surface 14C extends in the predetermined direction, and is contactable with the flat surface S1 of the agitator 4 when the one end portion 4C of the agitator 4 is inserted into the hole 14A. The flat surface 14C is in contact with the flat surface S1 of the one end portion 4C when the first gear 14 is rotated. As illustrated in FIG. 2, the flat surface 14C is in contact with one end portion of the flat surface S1 when the agitator 4 is positioned at the first position. A portion of the flat surface S1 in contact with the flat surface 14C when the agitator 4 is positioned at the first position will be referred to as a first portion P1. Further, as illustrated in FIG. 6, the flat surface 14C is in contact with another end portion of the flat surface S1 when the agitator 4 is positioned at the second position. A portion of the flat surface S1 in contact with the flat surface 14C when the agitator 4 is positioned at the second position will be referred to as a second portion P2.

With this structure, the rotation of the first gear 14 rotates the agitator 4 by maintaining contact between the flat surface 14C of the first gear 14 and the flat surface S1 of the one end portion 4C irrespective of first position and second position of the agitator 4.

In this way, the first gear 14 is rotatable along with the agitator 4 about the first axis A1 while the one end portion 4C of the agitator 4 is inserted into the hole 14A.

Further, as illustrated in FIGS. 2 and 4, the first gear 14 includes a plurality of gear teeth 14B positioned at the peripheral surface of the first gear 14 and arrayed in a circumferential direction thereof. The plurality of gear teeth 14B are in meshing engagement with the input gear 21. That is, the input gear 21 is in meshing engagement with the first gear 14. With this structure, the first gear 14 can be rotated upon receipt of driving force from the coupling 20 through the input gear 21.

3.4 Second Gear Cover 37

Figure 1:
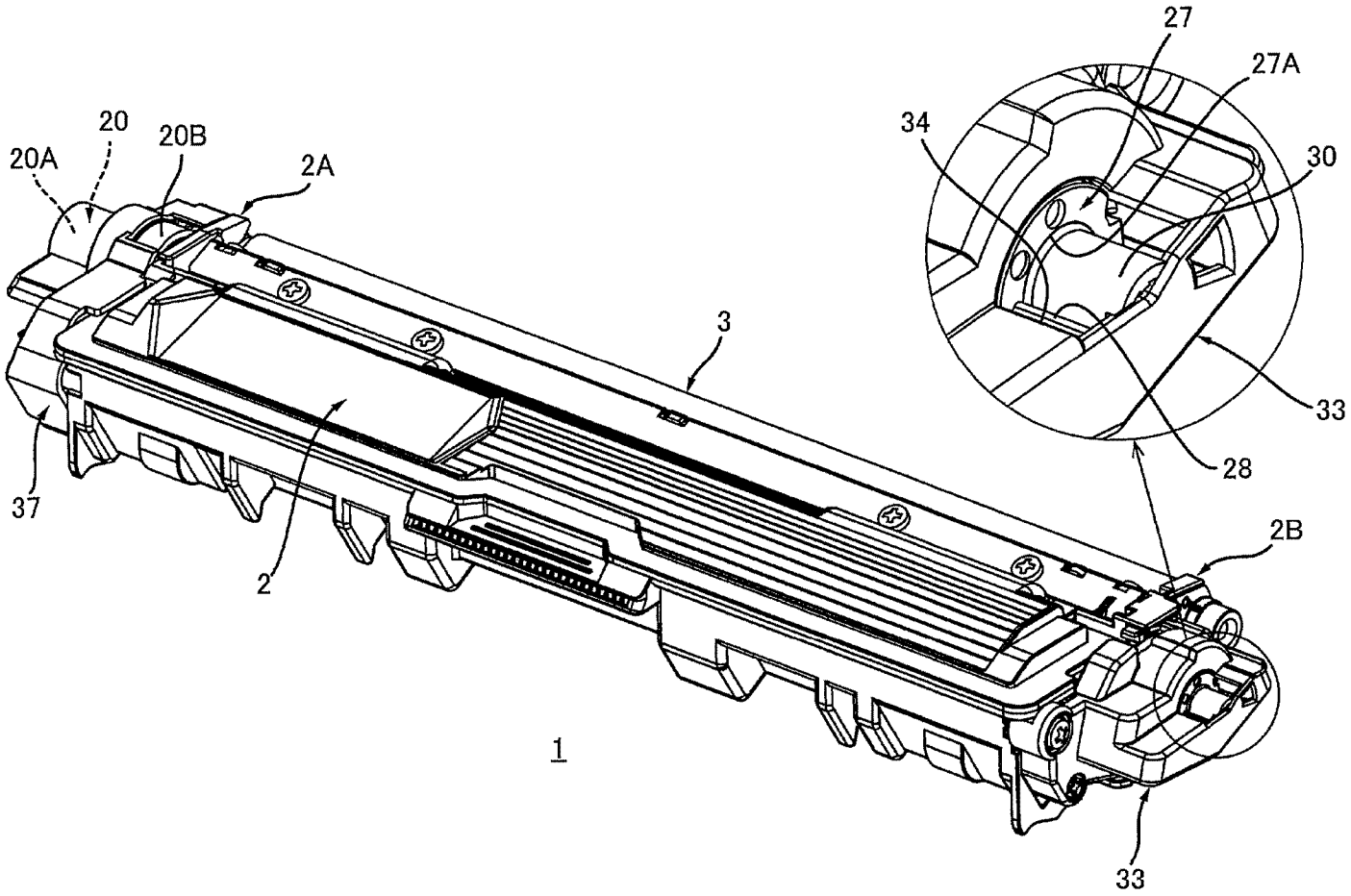
FIG. 1 is a perspective view of a developing cartridge according to a first embodiment.

The developing cartridge 1 further includes a second gear cover 37 as illustrated in FIGS. 1 and 2. The second gear cover 37 is attached to the outer surface of the side wall 2A of the casing 2 in the predetermined direction, and is configured to cover at least a portion of the first gear 14, coupling 20 and the input gear 21. As illustrated in FIG. 2, the second gear cover 37 includes a second convex 38.

The second convex 38 is configured to stop movement of the first gear 14 in the predetermined direction. More specifically, the second convex 38 protrudes inward in the predetermined direction from an inner surface of the second gear cover 37 toward the first gear 14. The first gear 14 is brought into abutment with the second convex 38 when the first gear 14 is moved in the predetermined direction from the outer surface of the side wall 2A of the casing 2 toward the second gear cover 37. Accordingly, the second convex 38 stops movement of the first gear 14 in the predetermined direction from the casing 2 toward the second gear cover 37.

Consequently, the first gear 14 can maintain meshing engagement with the input gear 21 regardless of the first position and the second position of the agitator 4.

4. Second Gear 15, Third Gear 37 and Protrusion 28

As illustrated in FIGS. 2 and 5, the developing cartridge 1 further includes a second gear 15, a third gear 27 and a protrusion 28.

4.1 Second Gear 15

The second gear 15 is positioned at an outer surface of the other side wall 2B of the casing 2 in the predetermined direction, and at a position opposite to the first gear 14 with respect to the casing 2. The second gear 15 has a size greater than a diameter of the first through-hole 8 of the casing 2. Therefore, the second gear 15 is abuttable on an outer open end of the first through-hole 8 when the second gear 15 moves in the predetermined direction from an outside of the casing 2 toward the outer surface of the other side wall 2B of the casing 2. Thus, the casing 2 prevents the second gear 15 from further moving from the outside of the casing 2 toward the outer surface of the other side wall 2B of the casing 2 in the predetermined direction. The second gear 15 is mounted to the other end portion 4D of the agitator 4 in the predetermined direction.

The second gear 15 has a hole 15A, as illustrated in FIG. 2. The hole 15A is recessed in the predetermined direction from one end portion of the second gear 15 toward another end portion thereof. The other end portion 4D of the agitator 4 is inserted into the hole 15A. The hole 15A has a shape in conformance with the cross-sectional shape of the other end portion 4D. An inner surface of the hole 15A has a flat surface 15C.

The flat surface 15C extends in the predetermined direction, and is contactable with the flat surface S3 of the agitator 4 when the other end portion 4D of the agitator 4 is inserted into the hole 15A. The flat surface 15C is in contact with the flat surface S3 of the other end portion 4D when the second gear 15 rotates.

With this structure, as illustrated in FIGS. 2 and 5, the second gear 15 is rotatable together with the agitator 4 about the first axis A1 in a state where the other end portion 4D of the agitator 4 is inserted into the hole 15A.

A spring 17 as an example of an elastic member is disposed in the hole 15A. In other words, the developing cartridge 1 further includes the spring 17.

The spring 17 is a compression coil spring extending in the predetermined direction, and is interposed between the other end portion 4D of the agitator 4 and the second gear 15 in the predetermined direction. The spring 17 is seated on the other end portion 4D of the agitator 4, and on a bottom surface of the hole 15A of the second gear 15. The spring 17 is compressed when the agitator 4 is at the first position. Therefore, the spring 17 urges the agitator 4 from the first position toward the second position. Incidentally, an elastic member other than the spring may be a sponge.

The second gear 15 includes a plurality of gear teeth 15B provided at a peripheral surface of the second gear 15 and arrayed in a rotational direction thereof.

The second gear 15 can be rotated upon receipt of driving force from the image forming apparatus. More specifically, the driving force transmitted to the first gear 14 through the coupling 20 and the input gear 21 is transmitted to the second gear 15 through the agitator 4. Thus, the second gear 15 is rotated upon receipt of driving force from the image forming apparatus.

4.2 Third Gear 27

The third gear 27 is positioned at the outer surface of the other side wall 2B of the casing 2 in the predetermined direction. The third gear 27 is positioned opposite to the coupling 20 with respect to the casing 2. The third gear 27 has a hole 27A and includes a plurality of gear teeth 27B.

The hole 27A extends through the third gear 27 in the predetermined direction. The shaft 30 extending from the other side wall 2B is inserted into the hole 27A in the predetermined direction.

The plurality of gear teeth 27B are positioned at a peripheral surface of the third gear 27, and are arrayed in a circumferential direction thereof.

As illustrated in FIG. 2, the third gear 27 is in meshing engagement with the second gear 15. Thus, the third gear 27 is rotatable about the shaft 30 upon receipt of driving force from the second gear 15. In other words, the third gear 27 is rotatable about a second axis A2 extending in the predetermined direction. The second axis A2 is an axis of the shaft 30.

4.3 Protrusion 28

As illustrated in FIGS. 1 and 5, the protrusion 28 is positioned opposite to the casing 2 with respect to the third gear 27 in the predetermined direction. The protrusion 28 is positioned around the hole 27A and extends in the predetermined direction from the third gear 27. In other words, the protrusion 28 is integral with the third gear 27, so that the protrusion 28 is movable along with the rotation of the third gear 27. More specifically, the protrusion 28 is rotatable together with the third gear 27. In this embodiment, the protrusion 28 is single. However, instead of the protrusion 28, a plurality of protrusions may be provided.

4.4 First Gear Cover 33

The developing cartridge 1 further includes a first gear cover 33. The first gear cover 33 is positioned opposite to the coupling 20 with respect to the casing 2, and is attached to the outer surface of the other side wall 2B of the casing 2 in the predetermined direction. The first gear cover 33 is configured to cover at least a portion of the second gear 15 and the third gear 27. The first gear cover 33 has an opening 34.

The opening 34 extends through a thickness of the first gear cover 33 in a direction crossing the predetermined direction as illustrated in FIG. 1. The protrusion 28 and the shaft 30 are exposed to the outside through the opening 34. Thus, the protrusion 28 is temporarily positioned outside the first gear cover 33 through the opening 34, and is then entered inside the first gear cover 33 through the opening 34 when the protrusion 28 rotates about the shaft 30. The first gear cover 33 includes a first convex 35, as shown in FIG. 2.

The first convex 35 is configured to stop movement of the second gear 15. More specifically, the first convex 35 extends inward in the predetermined direction toward the second gear 15 from an inner surface of the first gear cover 33. The second gear 15 is brought into abutment with the first convex 35 as a result of the movement of the second gear 15 in the predetermined direction from the outer surface of the other side wall 2B toward the first gear cover 33. Consequently, the first convex 35 prevents the second gear 15 from further moving toward the first gear cover 33 from the casing 2 in the predetermined direction.

5. Operation

Operation in the developing cartridge 1 will be described with reference to FIGS. 2 and 6. When the developing cartridge 1 is attached to the image forming apparatus, driving force is input from the drive input portion of the image forming apparatus to the coupling 20.

Then, the driving force is transmitted from the coupling 20 to the second gear 15 through the input gear 21, the first gear 14, and the agitator 4. Thus, the second gear 15 can rotate. By the rotation of the second gear 15, the third gear 27 is rotated upon receipt of the driving force from the second gear 15. Accordingly, the protrusion 28 is rotated along with the rotation of the third gear 27.

The protrusion 28 is positioned outside of the first gear cover 33 through the opening 34 (FIG. 1), and then, positioned inside the first gear cover 33 through the opening 34. In a state where the developing cartridge 1 is attached to the image forming apparatus, when the protrusion 28 is positioned outside the first gear cover 33, the protrusion 28 is brought into abutment with a lever (not illustrated) provided in the image forming apparatus. The lever is moved by the abutment. In the image forming apparatus, a sensor (not illustrated) is provided to detect the movement of the lever to generate signal pattern indicative of information of the developing cartridge 1 such as printable number of sheets with the developing cartridge 1 and whether the developing cartridge is a new cartridge or a used cartridge.

As illustrated in FIG. 2, the agitator 4 rotates while the boss 12 engages with the groove 9. Because of the rotation of the boss 12 and engagement between the boss 12 and the groove 9, the boss 12 moves along the groove 9, so that the boss 12 moves inward of the casing 2. Accordingly, the agitator 4 moves in the predetermined direction away from the second gear 15.

In accordance with the movement of the agitator 4 in the predetermined direction, the other end portion 4D disengages from the hole 15A of the second gear 15 as illustrated in FIG. 6. More specifically, the flat surface S3 of the other end portion 4D moves in the predetermined direction and separated from the flat surface 15C of the second gear 15. Accordingly, the second gear 15 cannot receive driving force from the agitator 4, thereby stopping rotation of the second gear 15.

As a result of the stopping rotation of the second gear 15, rotation of the third gear 27 in meshing engagement of the second gear 15 is stopped, and accordingly, movement of the protrusion 28 is stopped.

Further, by the rotation of the agitator 4, the boss 12 is moved out of the one end of the groove 9 and is positioned inside the casing 2. As a result, the agitator 4 is further moved in the predetermined direction by the urging force of the spring 17.

As a result, the protrusion 11 of the agitator 4 is brought into abutment with the inner surface of the casing 2. Accordingly, movement of the agitator 4 in the predetermined direction is stopped and the agitator 4 is at the second position. In other words, the protrusion 11 is in contact with the casing 2 when the agitator 4 is at the second position.

Further, in this case, since the first gear 14 does not move in the predetermined direction, the one end portion 4C of the agitator 4 moves in the predetermined direction through the hole 14A of the first gear 14. The flat surface 14C of the first gear 14 is in contact with the second portion P2 in the one end portion 4C of the agitator 4 when the agitator 4 is at the second position. Therefore, driving force from the first gear 14 can still be transmitted to the agitator 4.

Accordingly, the agitator 4 can be rotated upon receipt of the driving force from the first gear 14, while the driving force cannot be transmitted from the agitator 4 to the second gear 15.

In this way, the agitator 4 is movable in the predetermined direction from the first position as illustrated in FIG. 2 where the first gear 14 is in meshing engagement with the input gear 21 and the second gear 15 is mounted to the other end portion 4D of the agitator 4, to the second position as illustrated in FIG. 6 where the first gear 14 is in meshing engagement with the input gear 21 and the second gear 15 is separated from the other end portion 4D of the agitator 4.

8. Function and Effect

In the developing cartridge 1 according to the first embodiment, the second gear 15 can be separated from the other end portion 4D of the agitator 4 in accordance with the movement of the agitator 4 in the predetermined direction as illustrated in FIGS. 2 and 6. Therefore, rotation of the agitator 4 is not transmitted to the second gear 15 to stop rotation of the second gear 15. Rotation of the third gear 27 is stopped while the third gear 27 is in meshing engagement with the second gear 15. As a result, in the developing cartridge 1, rotation of the third gear 27 can be stopped to stop movement of the protrusion 28 without formation of toothless portion in the third gear 27.

Second Embodiment

A developing cartridge according to a second embodiment will next be described with reference to FIGS. 7 through 10, wherein like parts and components are designated by the same reference numerals as those shown in FIGS. 1 through 6 with addition of numeral "100".

Figure 8:
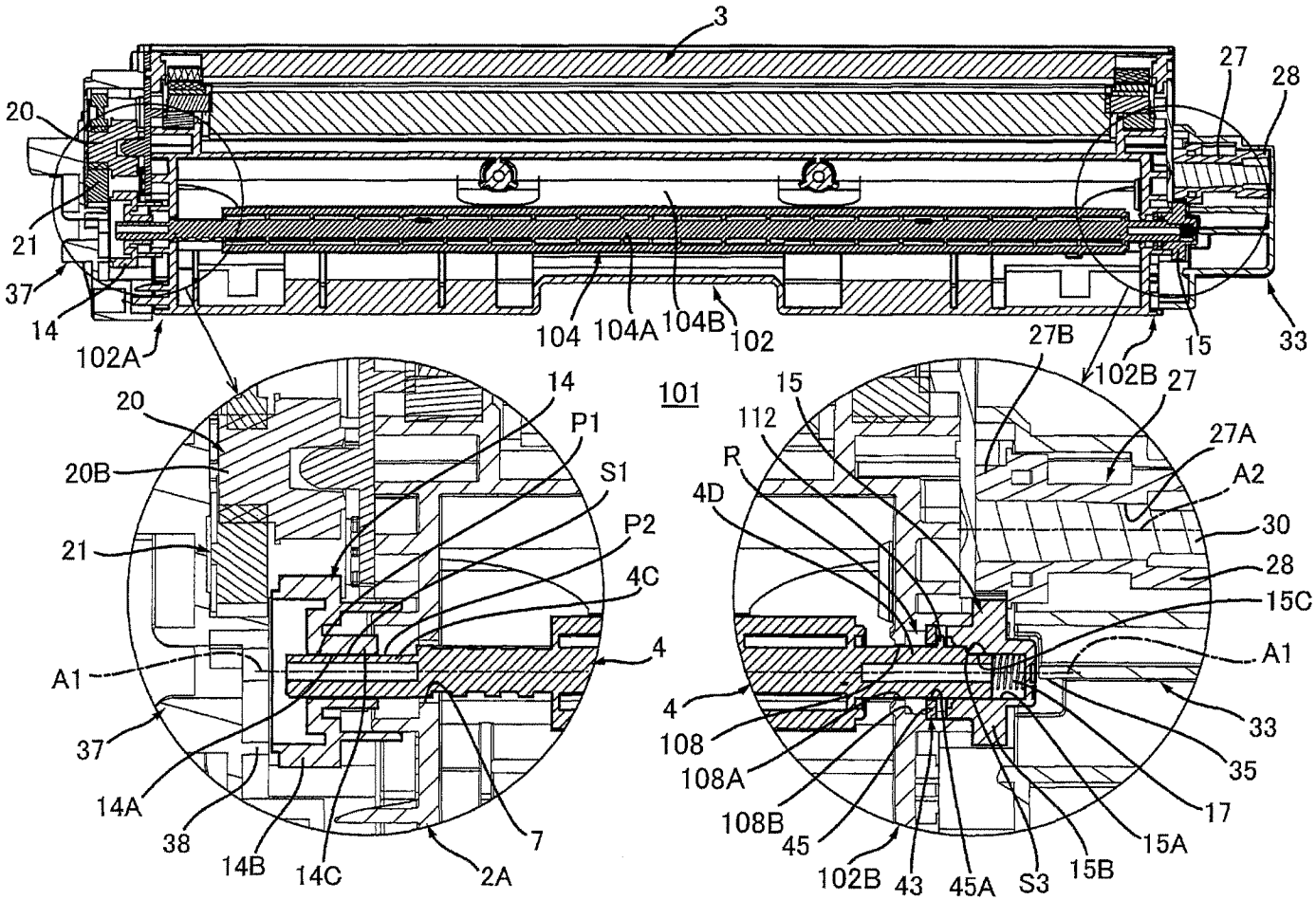
FIG. 8 is a cross-sectional view of the developing cartridge according to the second embodiment and illustrating a state where an agitator is at a first position.
Figure 9:
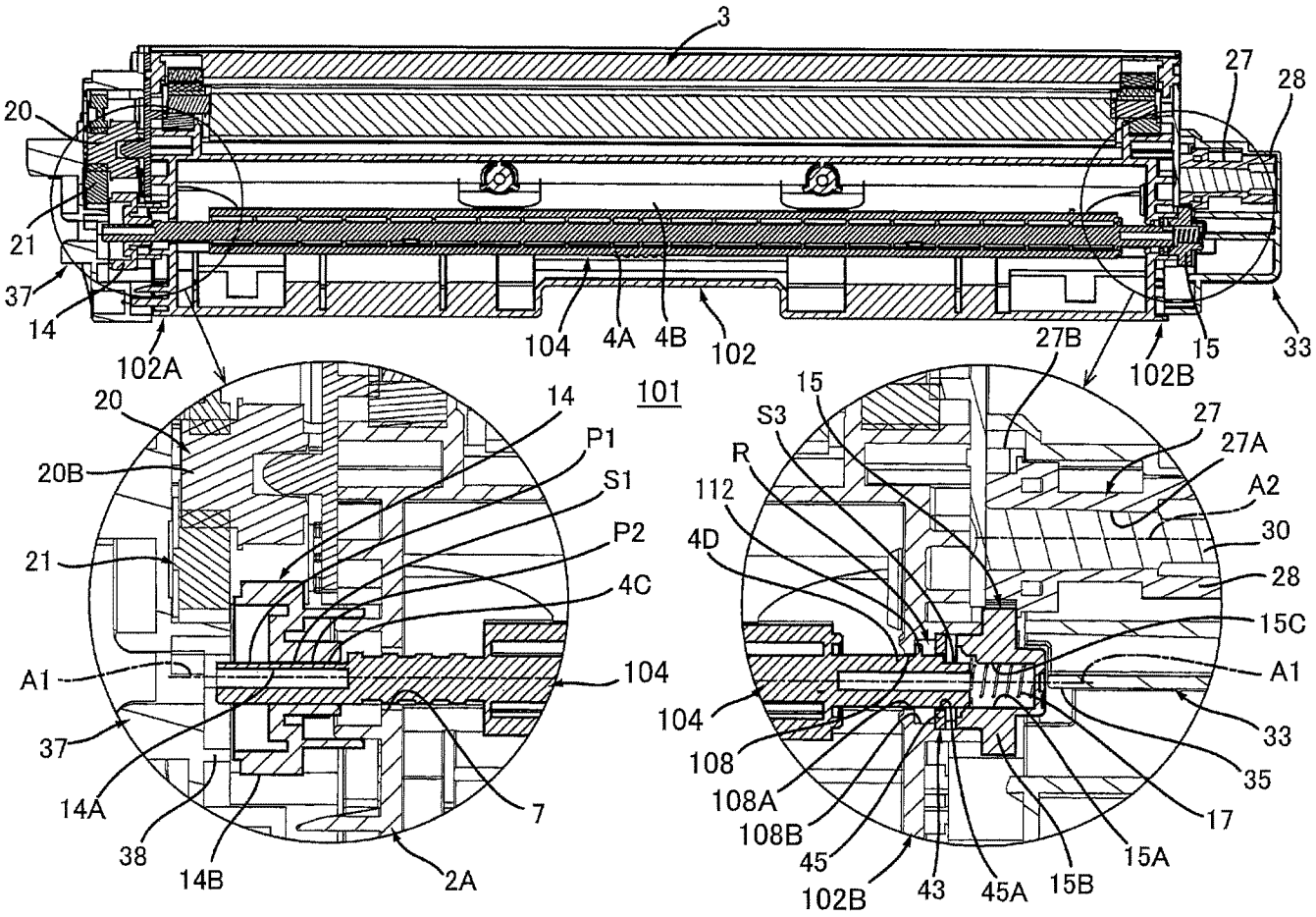
FIG. 9 is a cross-sectional view of the developing cartridge according to the second embodiment and illustrating a state where the agitator is at a second position.

As illustrated in FIGS. 8 and 9, a first through-hole 108 includes a first part 108A and a second part 108B. In the second embodiment, the groove 9 in the first embodiment is not formed at an inner peripheral surface of the through-hole 108 of a casing 102.

The first part 108A is one end portion of the first through-hole 108 in the predetermined direction. Another end portion 104D of an agitator 104 can be inserted into the first part 108A. The first part 108A is smaller than a rotational locus of a boss 112 of the agitator 104. In other words, the boss 112 cannot pass through the first part 108A of the first through-hole 108.

Figure 10B:
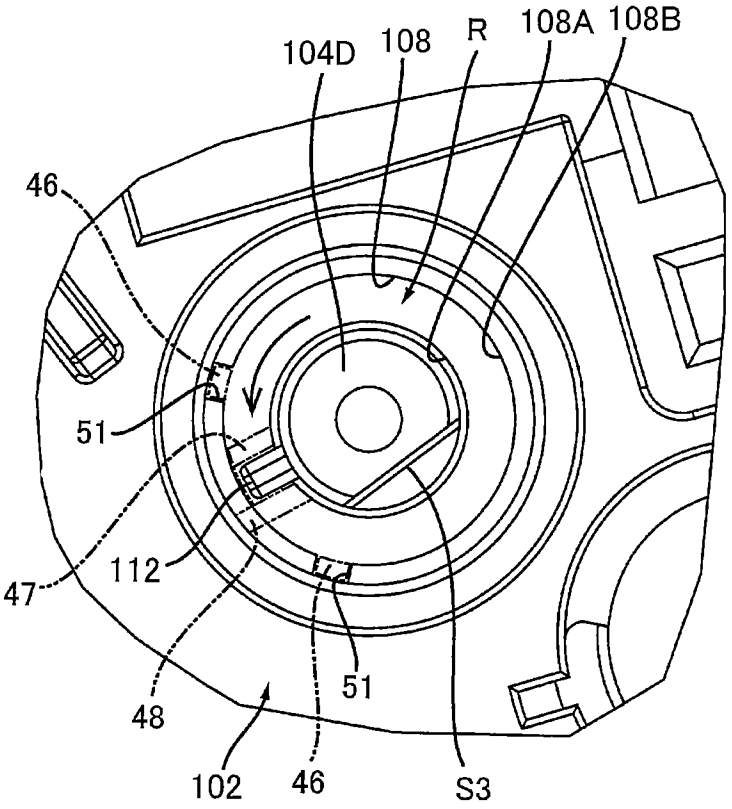
FIG. 10B is a view for description of movement of the boss relative to the ring member illustrated in FIG. 7 in the developing cartridge according to the second embodiment and in a state where the agitator is at the second position.

The second part 108B is another end portion of the first through-hole 108 in the predetermined direction. The second part 108B is positioned outward of the first part 108A and outward of the casing 102 in the predetermined direction. The second part 108B is larger than a rotational locus of the boss 112. A plurality of grooves 51 are formed at the inner peripheral surface of the second part 108B as illustrated in FIG. 10B.

Figure 7:
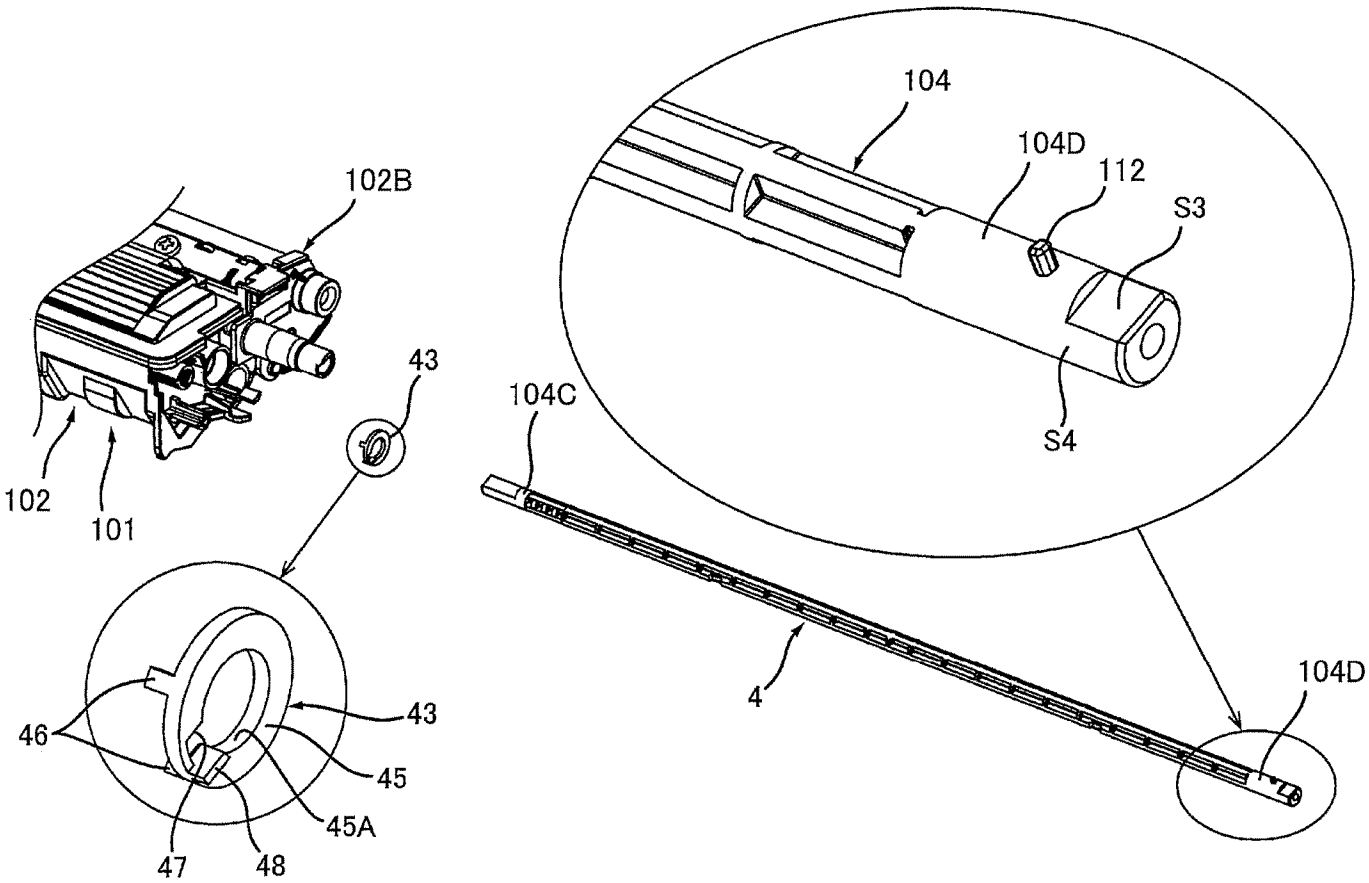
FIG. 7 is an exploded perspective view of a developing cartridge according to a second embodiment.

Further, a developing cartridge 101 includes a ring member 43 as illustrated in FIGS. 7 and 8. The ring member is positioned at an outer surface of another side wall 102B of the casing 102. More specifically, the ring member 43 is positioned between the casing 102 and the second gear 15 in the predetermined direction. The ring member 43 includes a body portion 45 having a hole 45A, and a plurality of protrusions 46, and a protrusion 48.

The body portion 45 is annular disc-shaped, and is larger than the first part 108A of the first through-hole 108. The body portion 45 is positioned outward of the first part 108A of the first through-hole 108 in the predetermined direction.

The hole 45A extends through a thickness of the body portion 45 in the predetermined direction. The other end portion 104D of the agitator 104 is inserted into the hole 45A.

Insertion of the other end portion 104D of the agitator 104 into the first through hole 108 and the hole 45A of the body portion 45 provides an annular space R at one side of the body portion 45. The annular space R is defined by the second part 108B of the first through-hole 108, the body portion 45, and the other end portion 104D of the agitator 104.

The plurality of protrusions 46 protrude in the predetermined direction toward the casing 2 from the body portion 45. These protrusions 46 are spaced away from each other in a circumferential direction of the body portion 45. Each of the protrusions 45 engages with each of the grooves 51. Therefore, the ring member 43 is subjected to positioning relative to the casing 102.

A hole 47 is formed in the body portion 45 at a position between the neighboring protrusions 46 in the circumferential direction of the body portion 45. The hole 47 extends radially outwardly from the hole 45A, and extends through a thickness of the body portion 45 in the predetermined direction. The hole 47 is sized to allow the boss 112 of the agitator 104 to pass therethrough in a state where the other end portion 104D of the agitator 104 is inserted through the hole 45A. The boss 112 can pass through the hole 47 upon alignment of the boss 112 with the hole 47 in the predetermined direction during rotation of the agitator 104.

The protrusion 48 is configured to abut against the boss 112 during rotation of the agitator 104 so as to prevent the boss 112 from moving past the hole 47. The protrusion 48 is positioned downstream side of the hole 47 in the rotational direction of the agitator 104. The protrusion 48 protrudes in the predetermined direction from the body portion 45 in a direction away from the casing 102.

The boss 112 is positioned between the ring member 43 and the second gear 15 in the predetermined direction when the agitator 4 is at the first position.

Figure 10A:
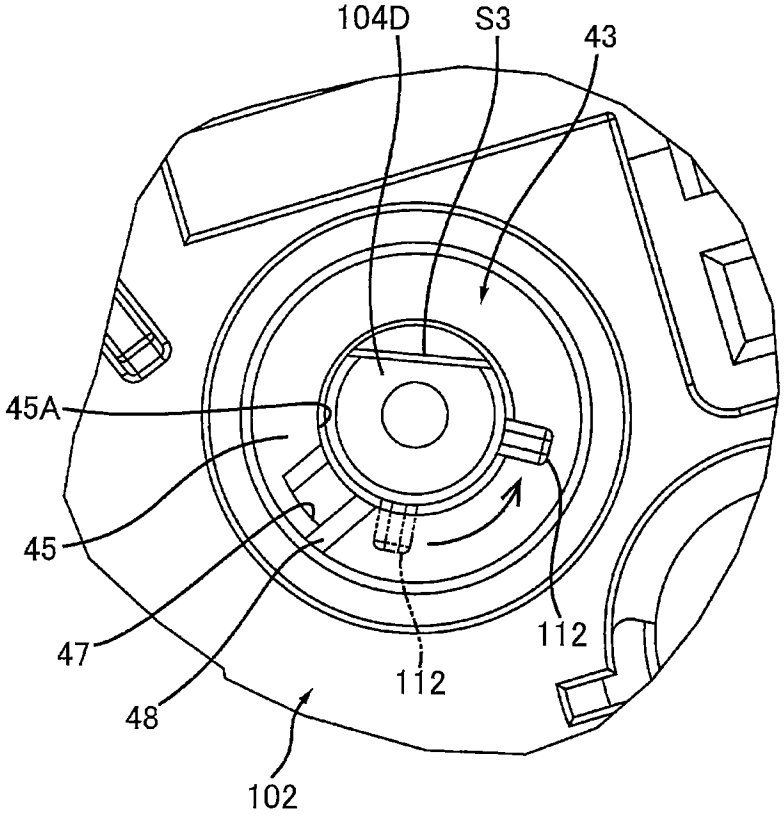
FIG. 10A is a view for description of movement of a boss relative to a ring member illustrated in FIG. 7 in the developing cartridge according to the second embodiment and in a state where the agitator is at the first position.

When the agitator 4 is rotated, the boss 112 is also circularly moved as illustrated in FIG. 10A. When the boss 112 is brought into alignment with the hole 47 in the predetermined direction, the boss 112 moves through the hole 47 because of the biasing force of the spring 17 as illustrated in FIGS. 9 and 10B. Accordingly, the boss 112 abuts against the casing 102 and is positioned in the annular space R.

Consequently, the second gear 15 is separated from the other end portion 104D of the agitator 104 to stop rotation of the second gear 15. Thus, the agitator 104 is moved from the first position to the second position.

The boss 112 is rotatable in the annular space R. Therefore, the agitator 104 is rotatable without transmission of driving force to the second gear 15. In this way, the second embodiment provides function and effect similar to those of the first embodiment.

Figure 11:
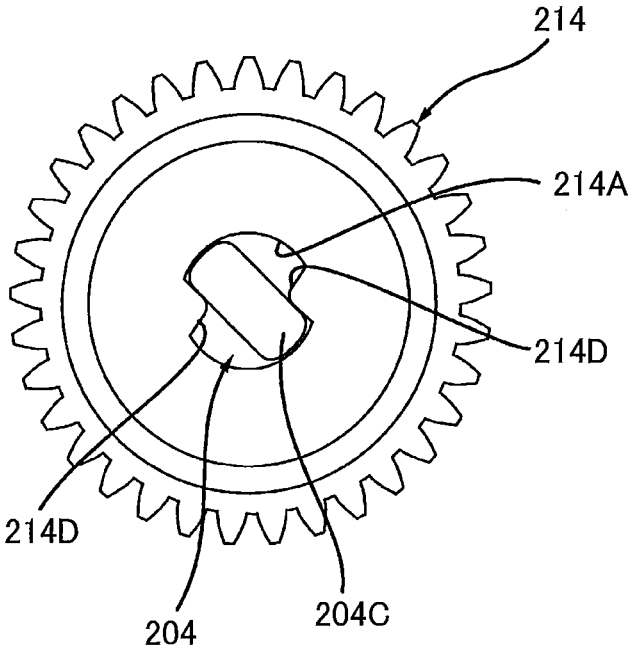
FIG. 11 is a view for description of co-rotation of a first gear and an agitator in a developing cartridge according to a modified embodiment.

A modified embodiment will be described with reference to FIG. 11. FIG. 11 illustrates co-rotation of a first gear 214 and an agitator 204. One end portion 204C of the agitator 204 has a flat spread-out shape, and two protrusions 214D protrudes radially inward from an inner surface of a hole 214A of the first gear 214. When the one end portion 204D is inserted into the hole 214A, the one end portion 204D abuts on the protrusions 214D. Therefore, the agitator 204 can be rotated along with the first gear 214 upon rotation of the first gear 214.

With this structure, a contact area between the one end portion 204C and the first gear 214 can be reduced. Therefore, the one end portion 204C can be smoothly moved through the hole 214A when the agitator 204 is moved from the first position to the second position.

While the description has been made in detail with reference to specific embodiments, it would be apparent to those skilled in the art that various changes and modifications may be made therein without departing from the spirit and scope of the above described embodiments.

What is claimed is:

1. A developing cartridge comprising:

a casing configured to accommodate therein toner;

an agitator configured to agitate the toner in the casing, the agitator being rotatable about a first axis extending in a predetermined direction, the agitator including one end portion and another end portion in the predetermined direction, the agitator being movable in the predetermined direction between a first position and a second position;

a first gear mounted to the one end portion, the first gear being rotatable along with the agitator;

an input gear engaging with the first gear;

a second gear mounted to the another end portion, the second gear being rotatable along with the agitator;

a third gear engaging with the second gear, the third gear being rotatable about a second axis extending in the predetermined direction; and a protrusion movable in accordance with a rotation of the third gear, the protrusion being rotatable along with the third gear, the second gear being mounted to the another end portion while the first gear and the input gear engage with each other in the first position, the second gear being separated from the another end portion while the first gear and the input gear engage with each other in the second position.

2. The developing cartridge according to claim 1, wherein the casing has a first through-hole allowing the another end portion to be inserted, the first through-hole having an inner peripheral surface; and a helical groove extending in the predetermined direction, the helical groove being provided at the inner peripheral surface, wherein the agitator includes a boss engaging with the helical groove in a case where the agitator is at the first position, wherein the agitator is rotatable according to rotation of the first gear, and the agitator is movable from the first position to the second position in a case where the boss moves along the helical groove.

3. The developing cartridge according to claim 2, wherein the second gear has a dimension greater than a dimension of the first through-hole, and the second gear is in contact with an open end of the first through-hole in a case where the second gear is movable from outside of the casing toward an outer surface of the casing.

4. The developing cartridge according to claim 1, further comprising:

a first gear cover attached to the casing and covering the third gear and the second gear, the first gear cover including a first convex extending toward the second gear in the predetermined direction to abut the second gear.

5. The developing cartridge according to claim 1, wherein the casing has a second through-hole allowing the one end portion to be inserted, wherein the agitator further includes a protrusion protruding from the one end portion of the agitator in a radial direction of the agitator, the protrusion being positioned inside the casing, the projection having a dimension greater than a dimension of the second through-hole, the protrusion being spaced away from the casing in the predetermined direction in a case where the agitator is at the first position, the protrusion being in contact with the casing in a case where the agitator is at the second position.

6. The developing cartridge according to claim 1, further comprising:

an elastic member positioned between the another end portion and the second gear in the predetermined direction, the elastic member urging the agitator in a direction from the first position to the second position.

7. The developing cartridge according to claim 1, further comprising:

a second cover attached to the casing, the second cover covering the first gear and the input gear, the second cover including a second convex extending in the predetermined direction toward the first gear, wherein the first gear is in contact with the second convex in a state where the first gear moves toward the second gear cover, wherein the first gear has a through-hole extending in the predetermined direction to allow the one end portion of the agitator to be inserted in a state where the one end portion of the agitator is movable in the predetermined direction, and the first gear is mounted to the one end portion of the agitator in a case where the agitator is at both the first position and the second position.

8. The developing cartridge according to claim 7, wherein the one end portion of the agitator has a flat surface extending in the predetermined direction, wherein the first gear has another flat surface extending in the predetermined direction, the another flat surface being configured to be in contact with the flat surface of the agitator in a state where the one end portion of the agitator is inserted through the through-hole, wherein the first gear rotates the agitator in a case where the another flat surface of the first gear is in contact with the flat surface of the agitator.

9. The developing cartridge according to claim 8, wherein the flat surface of the agitator includes a first region in contact with the another flat surface of the first gear in a case where the agitator is at the first position, and a second region in contact with the another flat surface of the first gear in a case where the agitator is at the second position, wherein the first gear rotates the agitator in a case where the another flat surface of the first gear is in contact with the flat surface of the agitator in a state where the agitator is at both the first position and the second position.

* * * * *